US006520226B1

(12) United States Patent
Smith

(10) Patent No.: US 6,520,226 B1
(45) Date of Patent: Feb. 18, 2003

(54) HIGHLY MANEUVERABLE LOG SPLITTING SYSTEM

(76) Inventor: Frank C. Smith, 46368 Y & O Rd., East Liverpool, OH (US) 43920

( * ) Notice: Subject to any disclaimer, the term of this patent is extended or adjusted under 35 U.S.C. 154(b) by 0 days.

(21) Appl. No.: 10/037,231

(22) Filed: Oct. 23, 2001

(51) Int. Cl.[7] ..... B27L 7/00

(52) U.S. Cl. ..... 144/366; 144/193.1; 144/195.1; 414/685; 280/727

(58) Field of Search ..... 144/193.1, 195.1, 144/366; 414/685; 280/727

(56) References Cited

U.S. PATENT DOCUMENTS

| | | | | | |
|---|---|---|---|---|---|
| 3,760,854 | A | | 9/1973 | Worthington et al. | 144/195.1 |
| 3,780,779 | A | | 12/1973 | Guy | 144/195.1 |
| 3,834,436 | A | | 9/1974 | Burkett | 144/366 |
| 3,963,131 | A | | 6/1976 | Dimmer | 214/140 |
| 4,285,374 | A | | 8/1981 | Klingel | 144/195.1 |
| 4,380,258 | A | * | 4/1983 | Hanser | 144/195.1 |
| 4,454,899 | A | | 6/1984 | Myers, Jr. | 144/195.1 |
| 4,506,712 | A | | 3/1985 | Johnson | 144/195.1 |
| 4,559,985 | A | | 12/1985 | May | 144/195.1 |
| 4,615,367 | A | * | 10/1986 | Crowley, Jr. | 144/195.1 |
| 5,803,141 | A | | 9/1998 | Patterson | 144/195.1 |
| 5,964,567 | A | | 10/1999 | Bamford | 414/685 |
| 6,408,907 | B1 | * | 6/2002 | Lantz | 144/195.1 |

* cited by examiner

*Primary Examiner*—W. Donald Bray
(74) *Attorney, Agent, or Firm*—James R. Eley; Thompson Hine LLP

(57) ABSTRACT

A method and apparatus is taught for engaging, positioning, and splitting logs. A wedge section of a skid steer loader coupling device is received in a lip section of a log splitting system coupling device. A body section of the skid steer loader coupling device is urged into a flush position with a body section of a log splitting system coupling device. Levers on the skid steer loader coupling device are actuated from a first position to a second position so that pin devices coupled to the levers move from a disengaged to an engaged position with respect to apertures in the log splitting system coupling device. Hoses are coupled at a first end of the log splitting system and at a second end of the skid steer loader. The skid steer loader is maneuvered proximate a first one of the logs to be engaged from above the first one of the logs. A pushing mechanism is actuated to push a first end of the first one of the logs with a pushing device a predetermined amount so that a second end of the first one of the logs interacts with a cutting device sufficiently to engage the first one of the logs. The skid steer loader is maneuvered to a predetermined location. Finally, said pushing mechanism is actuated until said engaged log is split at said predetermined location.

8 Claims, 4 Drawing Sheets

HIGHLY MANEUVERABLE LOG SPLITTING SYSTEM

FIELD OF THE INVENTION

This invention is directed towards a machine with a log splitting system. More particularly, the invention relates to a log splitting system and method for attaching a log splitting system to a skid steer loader to manipulate and split logs with increased maneuverability.

BACKGROUND OF THE INVENTION

The industry for removing and processing of trees has grown dramatically over the years in both the public and private sector. Storms, age, and sheer neglect can lead to fallen or dangerous trees. Also, time can lead to unwanted trees. Arborists, through use of tree moving and processing machines, service all these needs. It is often difficult to maneuver the required heavy machinery, tractors, front-end loaders, or the like, in areas with these trees to remove and process the trees. Generally, trees are partially cut into logs and placed into grinders, but when splitting of the logs is desired, large or awkward sections of the logs must be placed into log splitters. Traditionally, log splitters required a person to pick up the log or section of the log, move it over and on top of the log splitter, and to place it down into the log splitter and then activating the generally hydraulic actuator. This is very difficult for large or heavy logs. Also, after the logs are split, it is labor intensive and generally burdensome to move the pieces to form a pile or piles of split logs.

To overcome some of these problems, log splitters that cut wood from above the wood were developed, where some were maneuverable either through being pulled, pushed, or attached to a piece of machinery. U.S. Pat. No. 5,803,141 discloses a log splitting apparatus that can be attached to a backhoe. U.S. Pat. Nos. 4,506,712 and 4,454,899 disclose a log that can be attached to a backhoe. U.S. Pat. Nos. 4,506,712 and 4,454,899 disclose a log splitting apparatus that can be attached to a tractor. U.S. Pat. No. 3,760,854 discloses a log splitting apparatus that can be attached to a three-point hitch equipped vehicle. Unfortunately, all these systems require machines that need to be in very precise spots in order to pickup, move, and cut logs. This maneuvering of the machine usually takes several iterations of movement for every piece of wood, which slows down the process and makes the process quite tedious. Also, these machines have difficult coupling systems and procedures in order to attach the log splitting system on the machine to replace its normal operating arrangement. Often, coupling the log splitting system to the machine requires several people or a lot of time.

Therefore, a need exists for a machine with a log splitting system that easily engages, positions, and splits logs from above the logs, where the machine has increased maneuverability and can easily and quickly move around in small areas to manipulate and split logs of all sizes and shapes. Also, a need exists where the log splitting system can be easily, simply, and quickly coupled to the machine.

SUMMARY OF THE INVENTION

According to the present invention, a system is taught for engaging, positioning, and splitting logs. The system preferably comprises a skid steer loader comprising first, second, and third coupling devices and a log splitting system oriented so that it engages, positions, and splits the logs from above. The log splitting system comprises a fourth coupling device that is coupled to the first coupling device for attaching the log splitting system to the skid steer loader, a cutting device configured to manipulate and split the logs, a pushing device configured to push the logs against the cutting device in order to manipulate and split the logs, and hoses. The hoses comprise a fifth coupling device that couples a first one of the hoses to the log splitting system, a sixth coupling device that couples a second one of the hoses to the log splitting system, a seventh coupling device that couples the first of the hoses to the second coupling d device, and a eighth coupling device that couples the second one of the hoses to the third coupling device.

Also, according to the present invention, a method is taught for engaging, positioning, and splitting logs. A wedge section of a skid steer loader coupling device is received in a lip section of a log splitting system coupling device. A body section of the skid steer loader coupling device is urged into a flush position with a body section of a log splitting system coupling device. Levers on the skid steer loader coupling device are actuated from a first position to a second position so that pin devices coupled to the levers move from a disengaged to an engaged position with respect to apertures in the log splitting system coupling device. Hoses are coupled at a first end of the log splitting system and at a second end of the skid steer loader. The skid steer loader is maneuvered proximate a first one of the logs to be engaged from above the first one of the logs. A pushing mechanism is actuated to push a first end of the first one of the logs with a pushing device a predetermined amount so that a second end of the first one of the logs interacts with a cutting device sufficiently to engage the first one of the logs. The skid steer loader is maneuvered to a predetermined location. Finally, said pushing mechanism is actuated until said engaged log is split at said predetermined location.

A main advantage of the present invention is a log splitting system is easily and quickly coupled to a skid steer loader because there is very little user involvement in the coupling process so that it can be easily accomplished by a single person.

Another main advantage of the present invention is that once the log splitter is attached, the skid steer loader log splitting system is easily maneuverable in even small areas due to the skid steer loaders ability to pivot a full 360 degrees around a single point. This allows for easy engaging, positioning, and splitting of logs of any shape or size.

BRIEF DESCRIPTION OF THE DRAWINGS

Further features of the present invention will become apparent to those skilled in the art to which the present invention relates from reading the following specification and claims, with reference to the accompanying drawings, in which:

DESCRIPTION OF THE PREFERRED EMBODIMENT (S)

Figure 1:
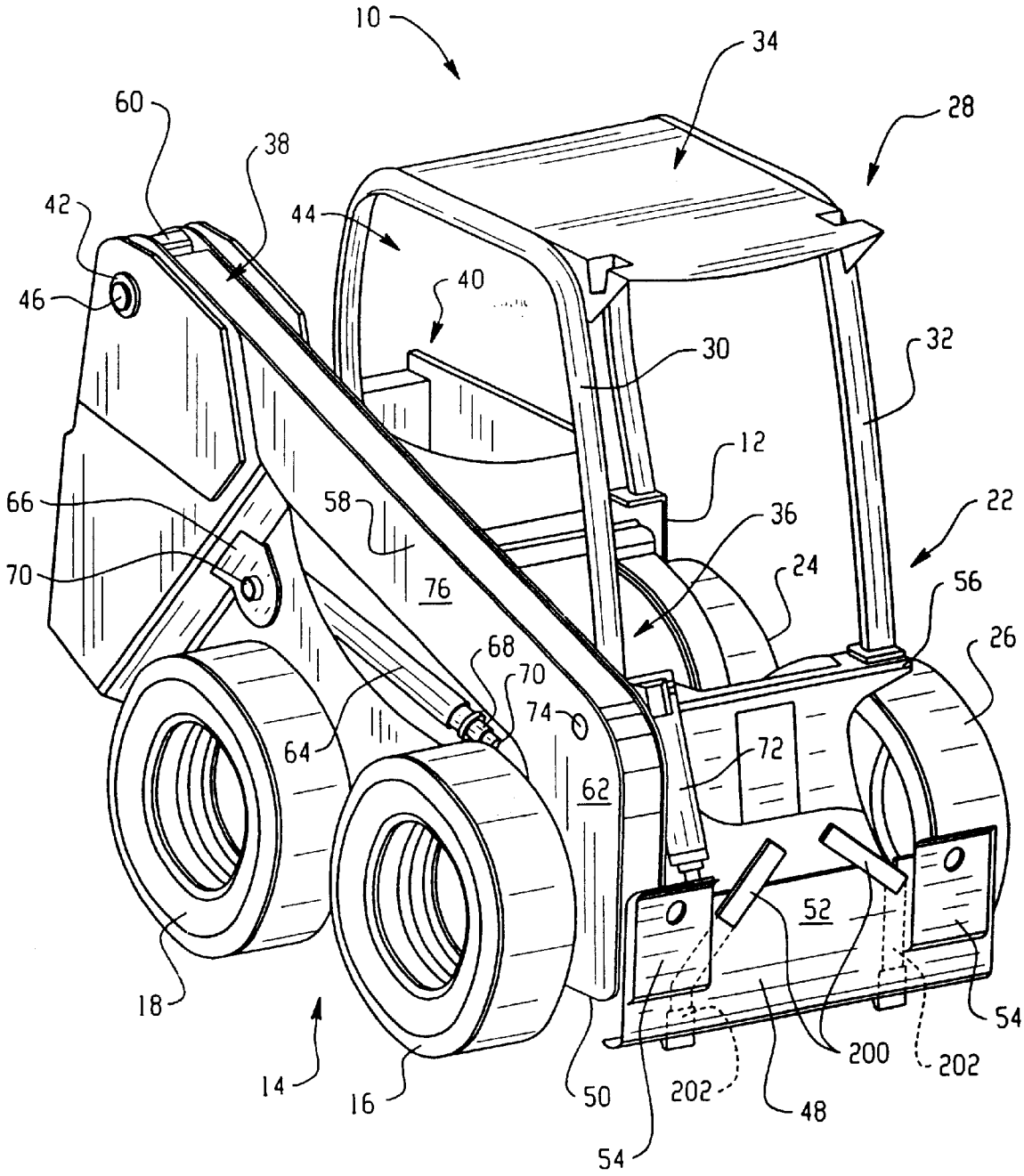
FIG. 1 shows a right-side perspective view of a skid steer loader in a system according to a preferred embodiment of the present invention.

As seen in FIG. 1, a machine 10 of a system 20 (FIG. 2) according to a preferred embodiment of the present invention is shown. Preferably, the machine 10 is a skid steer loader, although alternative machines with equivalent capabilities would work as well. The machine 10 is comprised of a body 12 that has a first ground engageable propulsion system 14 comprising a front ground engageable wheel 16 and a rear ground engageable wheel 18. On the opposite side of the body 12, a similar second ground engageable propulsion system 22 comprises a rear wheel 24 and a front wheel 26. Driving all four wheels at the same speed may propel the machine 10 in a straight line forwardly or rearwardly. Also, the machine 10 can be steered by driving wheels 16 and 18 at a different speed and/or direction with respect to wheels 24 and 26. If desired, the machine 10 can pivot a full 360 degrees around a single point. Thus, this machine 10 has a high degree of maneuverability. The machine 10 further comprises an operator's compartment 28 with side frames 30 and 32 and a top frame 34. These parts form an internal cavity 36 of the body 12 in which an operator's seat and conventional controls for driving and operating the machine 10 are provided.

Preferably, to facilitate skid steering, and in particular the ability of the machine 10 to turn about a central axis of the ground engageable propulsion means 14 and 22, respectively, a wheelbase is made slightly shorter than a track of the machine 10. It is to be appreciated that the wheelbase may be the same length or longer than the track if so desired. The maneuverability of the skid steer loader 10 distinguishes the system 20 of the present invention from all the prior art machines with log splitters, i.e., the ability to turn 360 degrees in place and move around in tight areas to engage, position, and split logs in a predetermined location, i.e., a pile if desired, easily and quickly.

The machine 10 further comprises a lift arm assembly 38 that is pivotally mounted adjacent a rear end 40 of the body 12 at an upper end of the lift arm assembly 38 via mounting bushings 42. Although not shown for convenience, it is appreciated that a similar lift arm assembly system as described herein below is mounted on the opposite side of the operator's compartment 28. The lift arm assembly 38 that is shown and described is adjacent a left side 44 of the operator's compartment 28. The lift arm assembly 38 has a receiving device (not shown) for a pivot pin 46, where the pivot pin 46 is received in the receiving device and in the bushings 42 to provide a pivot point for the lift arm assembly 38. At its forward end, the lift arm assembly 38 is coupled to a first coupling device 48 that projects from a front end 50 of the lift arm assembly 38 and extends transversely across the front end of the body 12 forwardly thereof. The first coupling device 48 has a body section 52 and a wedge section 54. The first coupling device 48 is carried by the lift arm assembly 38 so as to be disposed forward of the front end 56 of the body 12. Preferably, the lift arm assembly 38 also comprises second and third coupling devices, described hereinafter with reference to FIG. 2. Alternatively, the body 12 may carry the second and third coupling devices.

The lift aim 38 is formed as a generally square or rectangular section of tubular fabrication. It comprises a major part 58 that extends generally rectilinearly from the inner end 60 of the lift arm 38 and a minor part 62 that extends generally downwardly and forwardly relative to the major part 58 to terminate at the front end 50. A hydraulic lift ram 64 is pivotally connected between a reinforced part 66 and a bracket 68 welded to the lift arm 38 in the region of the junction between the major part 58 and the lift ram 64. The pivotal connection of the lift ram 64 at each end is comprised of a pivot pin 70 that is mounted in pivot bushes welded in openings provided in respective plates and brackets, where the pivot pin 70 extends through apertures provided in the lift ram 64 at opposite ends thereof A machine coupling device ram 72 is provided between a pivot pin 74 disposed in a cantilever 76 on the lift arm 38 and pivot mounting apertures (not shown) in the first coupling device 48.

Figure 2:
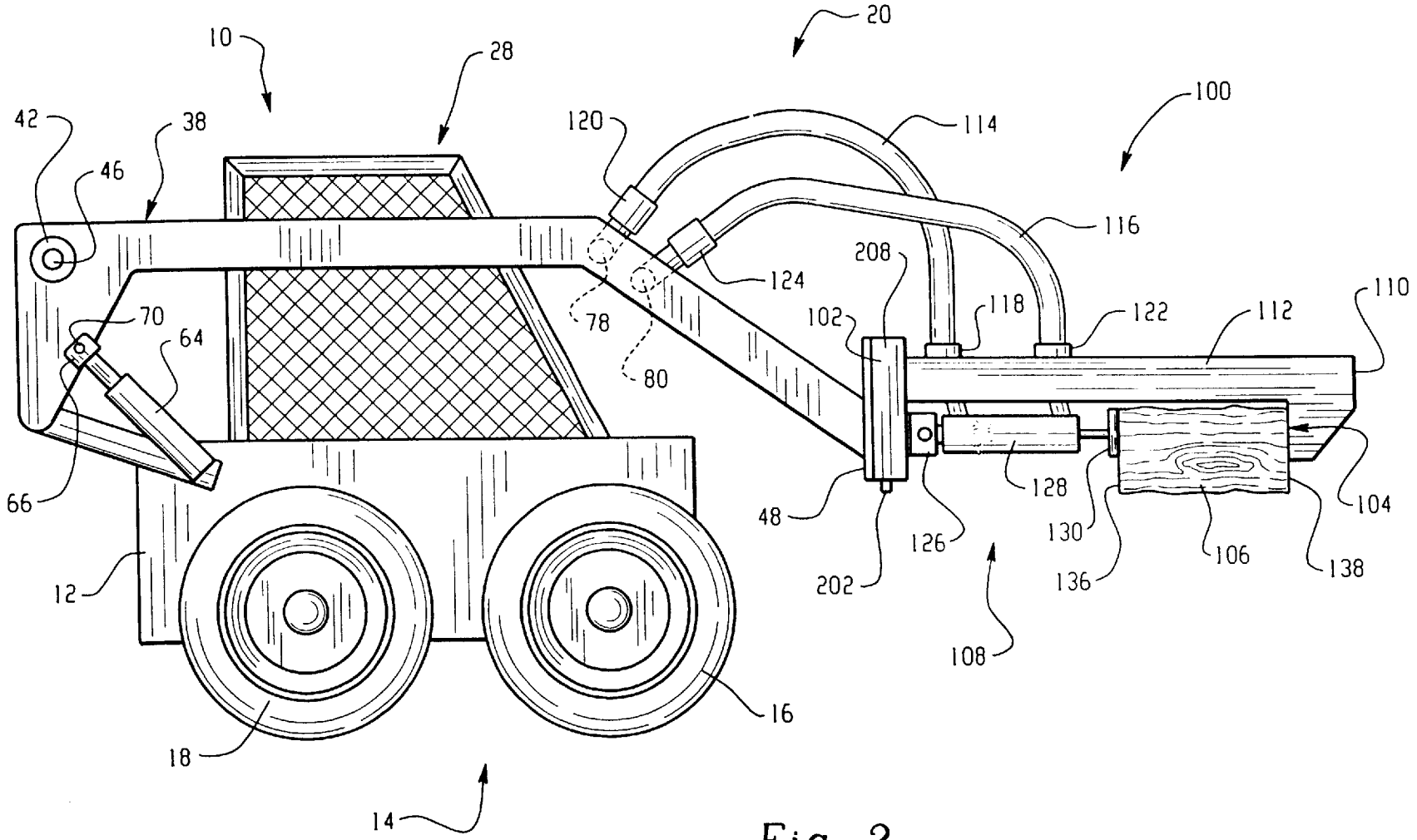
FIG. 2 shows a right-side view of the system according to a preferred embodiment of the present invention.

Turning now to FIG. 2, the system 20 is shown as preferably being a log splitting system 100 coupled to the machine 10. As discussed above, the machine 10 further includes a second coupling device 78 (shown in phantom) and a third coupling device 80 (shown in phantom). Although the second and third coupling devices 78 and 80, respectively, are shown as being integral with the lift arm 38, they may be integral with the body 12 or a lift arm on the opposite side, again not shown for convenience. Preferably, the second and third coupling devices 78 and 80, respectively, are configured as cylindrical extensions with threaded outer surfaces. Alternatively, the second and third coupling devices 78 and 80, respectively could be configured as cylindrical extensions both having threaded inner surfaces or one could have a threaded inner surface and one could have a threaded outer surface.

The log splitting system 100 comprises a fourth coupling device 102, which is used to couple the log splitting system 100 to the machine 10 via the first coupling device 48. This coupling process is described in more detail below with respect to FIG. 5. The log splitting ID system 100 further comprises a cutting device 104 configured to manipulate and split logs 106, a pushing device 108 configured to manipulate the logs 106 against the cutting device 104 in order to manipulate and split the logs, and a wood pushing section 110. The fourth coupling device 102, the cutting device 104, and the pushing device 108 form the log splitting system 100 through their interconnections to a main section 112.

The log splitting system 100 further comprises hoses 114 and 116 that couple a conventional on board hydraulic power system (not shown) of the machine 10 to the pushing or compression system 108 to power the pushing system 108. A first hose 114 has a fifth coupling device 118 to couple the first hose 114 to the pushing device 108 and a sixth coupling device 120 to couple the first hose 114 to the second coupling device 78. Similarly, a second hose 116 has a seventh coupling device 122 to couple the second hose to the pushing system 108 and an eighth coupling device 124 to couple the second hose 116 to the third coupling device 80. Preferably, the fifth through eighth coupling devices 118, 120, 122, and 124, respectively, are configured as cylindrical couplers with threaded inside surfaces. In alternative embodiments some or all of the fifth through eighth coupling devices 118, 120, 122, and 124, respectively, could be configured as cylindrical couplers with threaded outside surfaces.

Figure 3:
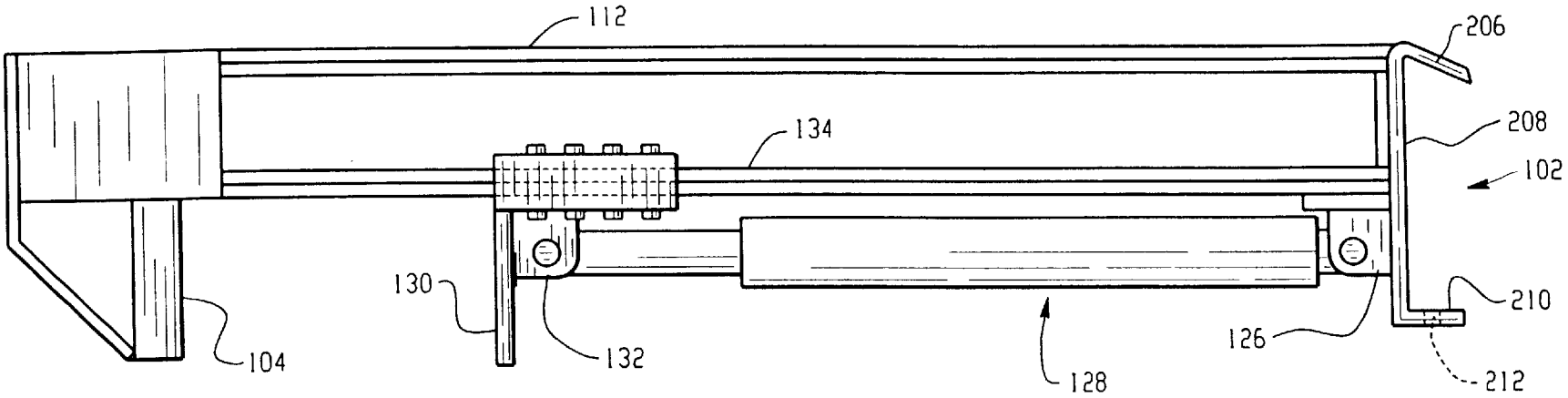
FIG. 3 shows a left-side view of a log splitting system of FIG. 2.
Figure 4:
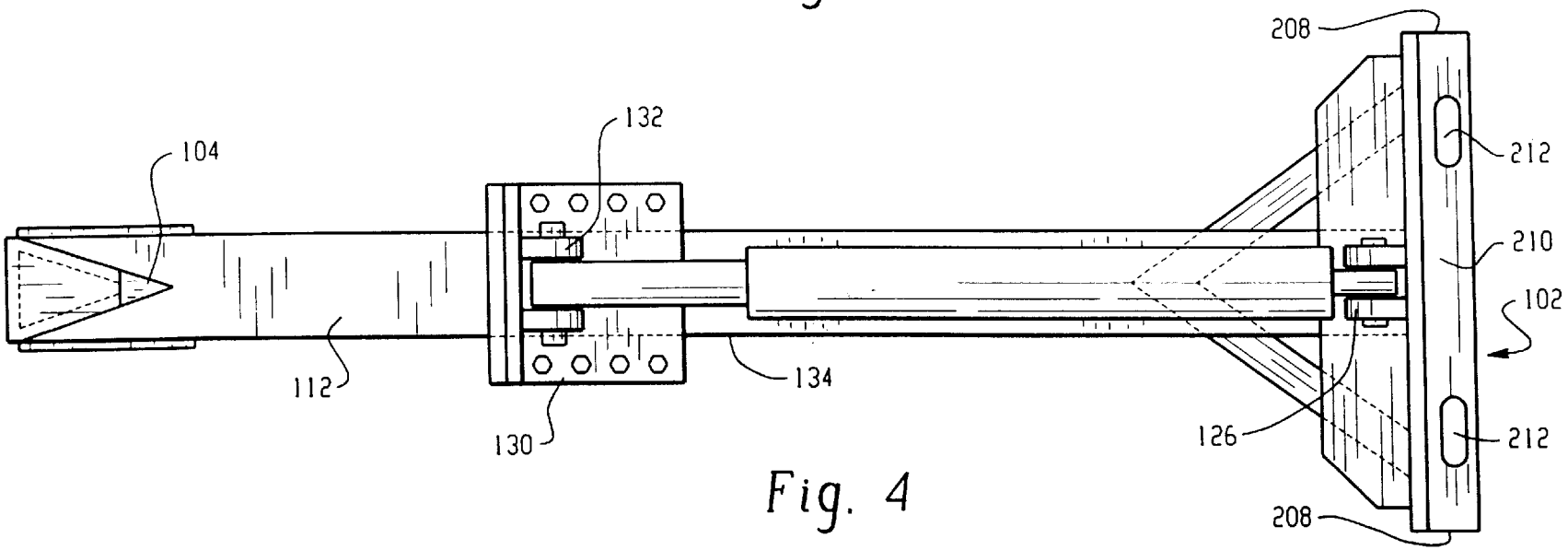
FIG. 4 shows a bottom view of the log splitting system of FIGS. 2 and 3.

With reference to FIGS. 3 and 4, and continuing reference to FIG. 2, a more detailed view of the pushing device 108 is shown. The pushing device 108 preferably comprises a hydraulic section 128, which is coupled at a first end to the fourth coupling device 102 via a bracket 126 and is coupled at a second end to a plate section 130 via a bracket 132. The plate section 130 slides along a sliding portion 134 of the main section 112 when pushed and pulled by the hydraulic section 128.

During a log splitting operation of the system 20, the pushing section 108 is powered by the on board hydraulic powering system via the hoses 114 and 116 to push and pull the plate section 130. The plate section 130 slides along the sliding portion 134 causing the plate section 130 to push on a first end 136 of the log 106. The cutting device 104 interacts with a second end 138 of the log 106. To engage a log, an operator actuates the skid steer loader controls to exert a predetermined amount of pressure on the log 106 when the log is between the pushing section 108 and the cutting section 104. Then, through use of the skid steer loader maneuverability, the operator can position the log 106 so that it is over a predetermined splitting location, such as a pile. Once over the splitting location, the operator increases the pressure exerted by the pushing section 108 until the log 106 is pushed through the cutting device 104 by the plate section 130, which splits the log 106.

Figure 5:
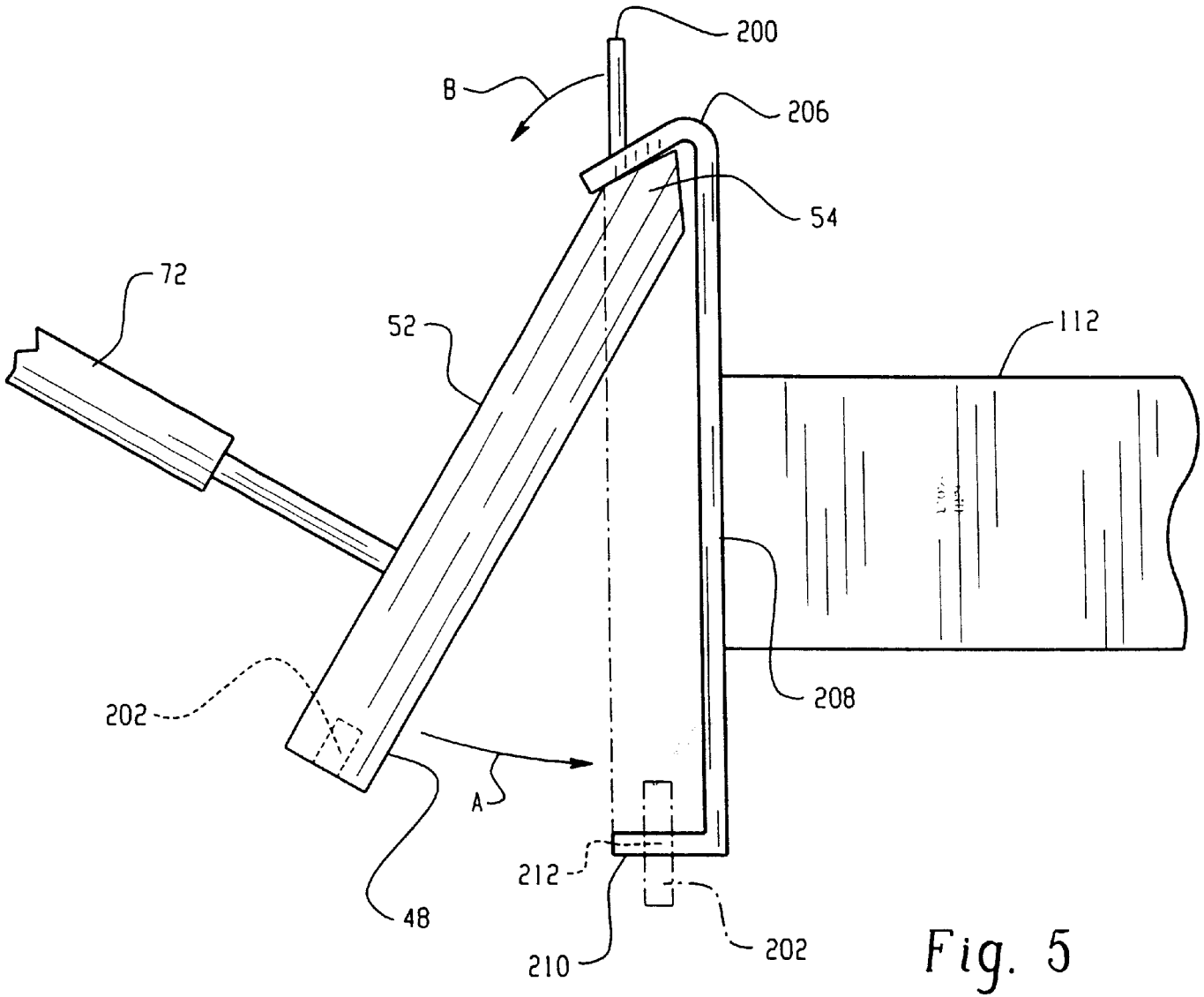
FIG. 5 shows a right-side view of two stages of coupling between couplers of the system according to a preferred embodiment of the present invention.

Turning now to FIG. 5, with continuing specific reference to FIGS. 3 and 4, and continuing general reference to FIGS. 1 and 2, features of the first and fourth coupling devices 48 and 102, respectively, and a process used to couple the first coupling device 48 of the machine 10 to the fourth coupling device 102 of the log splitting system 100 will be described. In FIG. 1, the first coupling device 48 is shown to comprise the body section 52 and wedge sections 54. Also, as shown in FIG. 1, the first coupling device 48 further comprises a pivoting lever 200 coupled to a moving pin device 202, where the pin device 202 is shown in a disengaged and retracted position in phantom in FIG. 1, but in an extended and engaged position, with respect to the fourth coupling device 102 in FIGS. 2 and 5. As best seen in FIGS. 3 and 5, the fourth coupling device 102 comprises a body section 204, a lip section 206 coupled to and extending at a predetermined downward angle from the body section 204, side sections 208 coupled to and extending substantially perpendicular to the body section 204, and a bottom section 210 coupled to and extending substantially perpendicular to the body section 204. As best seen in FIG. 4, the bottom section 210 comprises apertures 212.

To couple the log splitting system 100 to the machine 10, the machine coupling device ram 72 moves the wedge sections 54 of the first coupling device 48 into a position where they are received by the lip section 206 of the fourth coupling device 102. Once the wedge sections 54 are received in the lip section 206, the ram 72 moves the first coupling device 48 in the direction of the arrow A in FIG. 5 until the body section 52 is flush with the body section 208 of the fourth coupling device 102. After this is accomplished, one, then the other, of the levers 200 is moved either via controls in the skid steer loader or manually by an operator from a first position to a second position, in the direction of the arrow B in FIG. 5, until the pin device 202 is fully extended and in an engaged position, i.e., received in the aperture 212. Once these steps are completed, the machine 10 and log splitting system 100 are secured to one another and the system 20 is in condition to be used to manipulate and split wood, as was described in detail above.

It is to be appreciated that other skid steer loaders with alternative configurations can be used in the system 20 of the present invention without departing from the scope of the invention. Thus, other coupling arrangements can be used on both the machine 10 and the log splitting system 100.

The invention has been described in detail with respect to specific embodiments thereof, but it will be apparent that numerous variations and modifications are possible without departing from the spirit and scope of the invention as defined by the following claims.

I claim:

1. A system configured to manipulate and split logs, the system comprising:

a skid steer loader comprising first, second, and third coupling devices; and a log splitting system oriented to engage, position, and split the logs from above the logs, the log splitting system comprising:

a fourth coupling device that is coupled to the first coupling device to couple the skid steer loader to the log splitting system;

a cutting device configured to engage one end of the logs and split the logs;

a pushing device configured to push the logs against the cutting device in order to engage another end of the logs, position, and split the logs; and hoses, the hoses comprising a fifth coupling device that couples a first one of the hoses to the log splitting system, a sixth coupling device that couples a second one of the hoses to the log splitting system, a seventh coupling device that couples the first of the hoses to the second coupling device, and a eighth coupling device that couples the second one of the hoses to the third coupling device.

2. The system of claim 1, wherein the first coupling device comprises:

a body section, the body section being configured to rotate with respect to the skid steer loader via a hydraulic system on the skid steer loader;

wedge sections extending from a first edge of the body section;

levers positioned adjacent the wedge sections, the levers being configured to pivot; and pin devices adjacent a second edge of the body section, wherein a first one of the pin devices is coupled to a first one of the levers and a second one of the pin devices is coupled to a second one of the levers, wherein the first and second one of the pin devices are configured to move into an engaging position by pivoting the first and second one of the levers, respectively, from a first position to a second position.

3. The system of claim 1, wherein:

the second coupling device is configured as a cylindrical device with a threaded surface, wherein the second coupling device extends from the skid steer loader; and the seventh coupling device is configured as a cylindrical device with a threaded surface;

wherein the threaded surface of the second coupling device interacts with the threaded surface of the seventh coupling device to interconnect the second and sixth coupling devices.

4. The system of claim 1, wherein the fourth coupling device comprises:

a body section;

a lip section coupled to and extending at a predetermined angle from the body section;

side sections coupled to and extending substantially perpendicular to the body section; and a bottom section coupled to and extending substantially perpendicular to the body section, the bottom section comprising apertures.

5. The system of claim 1, wherein:

the third coupling device is configured as a cylindrical device with a threaded surface, wherein the second coupling device extends from the skid steer loader; and the eighth coupling device is configured as a cylindrical device with a threaded surface;

wherein the threaded surface of the third coupling device interacts with the threaded surface of the eighth coupling device to interconnect the second and sixth coupling devices.

6. The system of claim 1, wherein the pushing device comprises:

a hydraulic section, a first end of the hydraulic system being coupled to the log splitting system; and a plate section coupled to a second end of the hydraulic section;

wherein the hydraulic section is powered via the skid steer loader through use of the hoses;

wherein the plate section presses against a first end of a first one of the logs;

wherein a second end of the first one of the logs interacts with the cutting device; and wherein the pushing device pushes with a predetermined pressure to manipulate and split the logs.

7. The system of claim 1, wherein the system further comprises a wood pushing section configured to push the wood.

8. A method of engaging, positioning, and splitting logs, the method comprising the steps of:

receiving a wedge section of a skid steer loader coupling device in a lip section of a log splitting system coupling device;

urging a body section of the skid steer loader coupling device into a flush position with a body section of-a log splitting system coupling device;

pushing levers on the skid steer loader coupling device from a first position to a second position so that pin devices coupled to the levers move from an disengaged to an engaged position with respect to apertures in the log splitting system coupling device;

coupling hoses at a first end to the log splitting system and at a second end to the skid steer loader;

maneuvering the skid steer loader proximate a first one of the logs to be engaged from above the first one of the logs;

actuating a pushing mechanism to push a first end of the first one of the logs with a pushing device a predetermined amount so that a second end of the first one of the logs interacts with a cutting device sufficiently to engage the first one of the logs;

maneuvering the skid steer loader to a predetermined location; and actuating said pushing mechanism until said engaged log is split at said predetermined location.

* * * * *